United States Patent [19]

Sartor

[11] Patent Number: 4,888,889

[45] Date of Patent: Dec. 26, 1989

[54] SUPPORT ADJUSTER DEVICE FOR THE QUARTERS OF SKI BOOTS

[75] Inventor: Mariano Sartor, Montebelluna, Italy

[73] Assignee: Nordica S.P.A., Montebelluna, Italy

[21] Appl. No.: 785

[22] Filed: Jan. 5, 1987

[30] Foreign Application Priority Data

Jan. 13, 1986 [IT] Italy ..... 20463 B/86

[51] Int. Cl.[4] ..... A43B 5/04

[52] U.S. Cl. ..... 36/117; 36/118; 36/121

[58] Field of Search ..... 36/117–121

[56] References Cited

U.S. PATENT DOCUMENTS

| | | | |
|---|---|---|---|
| 3,729,841 | 5/1973 | Wagner | 36/120 X |
| 4,203,235 | 5/1980 | Van Pelt, Jr. | 36/118 |
| 4,449,274 | 5/1984 | Balbinot | 36/117 X |
| 4,467,538 | 8/1984 | Olivieri | 36/121 |
| 4,565,017 | 1/1986 | Ottieri | 36/117 |
| 4,575,957 | 3/1986 | Petrini | 36/121 |
| 4,658,517 | 4/1987 | Miyoshi et al. | 36/117 |

FOREIGN PATENT DOCUMENTS

| | | | |
|---|---|---|---|
| 0014124 | 8/1980 | European Pat. Off. | 36/118 |

*Primary Examiner*—James Kee Chi

*Attorney, Agent, or Firm*—Guido Modiano; Albert Josif

[57] ABSTRACT

The present invention relates to a support adjuster device for the quarters of ski boots including a shaped body, pivoted to the quarter of a ski boot, and means for adjusting and releasably locking the shaped body in any desired position with respect to the quarter. The device enables a skier to adjust the abutment of the quarter on the leg as desired through easily operable means.

2 Claims, 4 Drawing Sheets

SUPPORT ADJUSTER DEVICE FOR THE QUARTERS OF SKI BOOTS

BACKGROUND OF THE INVENTION

The present invention relates to a support adjuster for the quarters of ski boots.

As is known, to practice skiing correctly it is necessary for the rear quarter, and possibly the front quarter, of rear-entry ski boots, or the rear part of the single quarter in the case of front-entry ski boots, to offer some support to the rear part of the leg substantially in the region of the calf.

In the French Patent no. 2.089.128, a rear support device is described which comprises a tab which can be adapted to the calf of the skier, a support adjustment system is also described, but this system is, in practice, scarcely practical for the user and is rather complicated to provide. In most ski boots, this kind of support cannot be adjusted according to one's own skiing requirements, so that in practice the user adjusts the rear support offered by the quarter by varying the closing action of the quarter itself.

SUMMARY OF THE INVENTION

The aim proposed by the present invention is to solve the above described problem by providing a support adjuster specifically adapted for the quarters of ski boots, which allows the user the possibility of adjusting as required the supporting action effected on the leg by the upper end of the quarter independently from the closing action exerted on the user's foot by the conventional closure means.

Within the scope of the above described aim, a particular object of the invention is to provide an adjuster which allows to achieve a greater adaptation to large calves in order to reduce pressures on the upper part.

Still another object of the invention is to provide a support adjuster which is very quick and simple to operate, since it does not require particular or in any way complicated maneuvers.

Still another object of the present invention is to provide a rear support adjuster which can be fitted with extreme ease and speed to a ski boot, without thereby giving rise to particular complexities in structure.

A not least object of the present invention is to provide a support adjuster which is structurally simple and which, furthermore, is of very low cost.

The above described aim, as well as the objects mentioned and others which will become apparent hereinafter, are achieved by a support adjuster device for a ski boot of the type comprising a foot portion supporting a front and a rear quarter and a boot closure means, said support adjuster device being associated with at least one of said front and rear quarters and arranged for bearing against a tibial and calf portion of a skier's lower leg, said at least one support adjuster device including a main body shaped to at least partially embrace the respective front and rear surface portion of the skier's lower leg and means for movably connecting said body with the upper end of the associated quarter, the improvement consisting in that said support adjuster device further comprises means for selectively adjusting the position thereof with respect to the associated quarter independently from the operating position of said boot closure means, means being provided for releasably locking said device in said independently adjusted position, to thereby cause said device to exert on the respective calf and tibial region of the skier's lower leg a supporting action of selected value independent from the clamping action exerted on the skier's foot by said boot closure means.

BRIEF DESCRIPTION OF THE DRAWINGS

Further characteristics and advantages will become apparent from the detailed description of a support adjuster for the quarters of ski boots, illustrated only by way of non-limitative example in the accompanying drawings, wherein.

DESCRIPTION OF THE PREFERRED EMBODIMENTS

Figure 2:
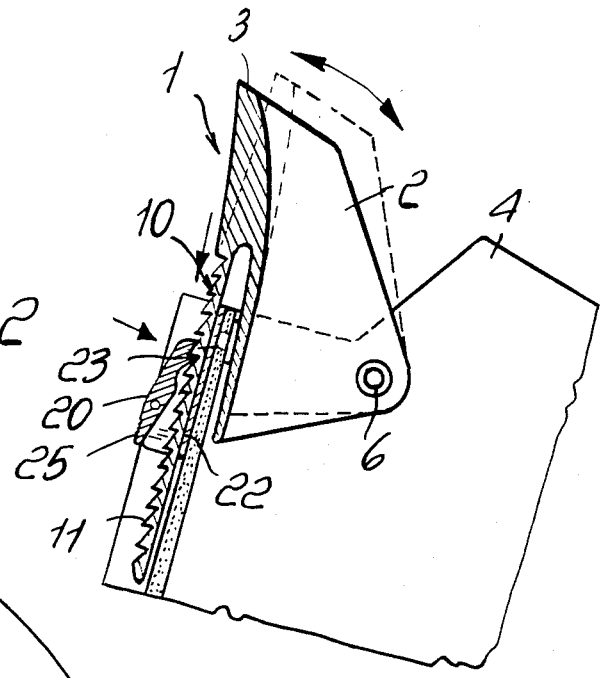
FIG. 2 is a longitudinal cross section view of the support adjuster of FIG. 1.
Figure 1:
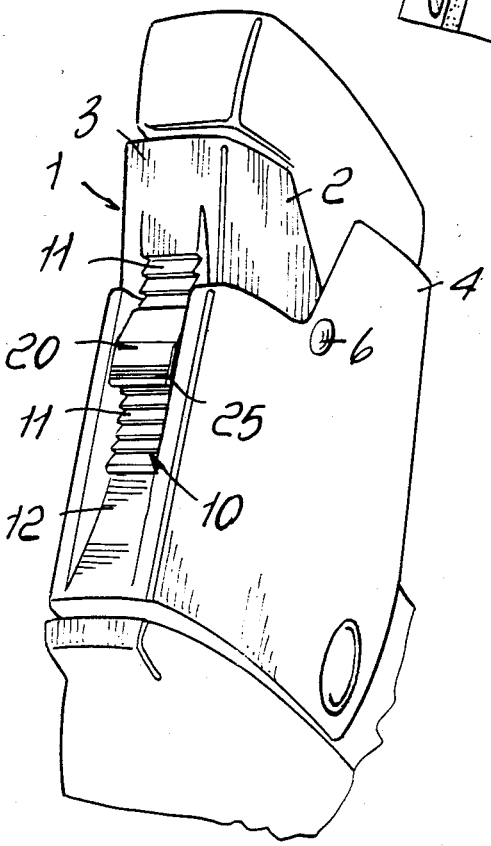
FIG. 1 is a schematic perspective rear view of a quarter of a ski boot bearing a rear support adjuster, according to the invention.

With reference to FIGS. 1 and 2, the support adjuster for ski boot quarters, according to the invention, comprises a shaped body, generally indicated by the reference numeral 1, which in the illustrated embodiment is shaped so as to embrace at least a portion of the rear part of the leg of a skier. More in detail, the shaped body 1 is provided with lateral fins 2 tapering forwards which join to a central portion 3 which can be positioned in the rear part of the leg of a skier, substantially below the region affected by the calf.

The fins 2, at their tapered end, are connected to the quarter 4 by means of a coupling which is preferably, a hinge-like or oscillable connection.

As illustrated in the figures, studs or pivots are provided, indicated by the reference numeral 6, which connect the fins 2 with the lateral part of the quarter 4 so as to allow an oscillation of the shaped body 1 about an axis which is substantially transverse with respect to the longitudinal extension of the leg and transverse with respect to the longitudinal extension of the foot.

A dentellated tab 10, provided with saw-like teeth 11, extends downwards from the connecting portion 3, and is accommodated in a recess 12 defined on the outer part of the quarter, while the shaped body is mainly accommodated inside the quarter.

Means are furthermore provided for the releasable locking of the position of the shaped body, which are composed of a small lever 20 pivoted in a middle portion thereof to its supporting base 22 and provided, at one end, with engagement teeth 23 which couple with the saw-like teeth 11.

Elastic means act, in a per se known manner, on the small lever 20, which means keep the engagement teeth elastically engaged with the saw-like teeth of the tab 10, thus obtaining a coupling which allows upward displacement of the dentellated tab with a ratcheting motion of the engagement teeth on the teeth of the dentellated tab, while they perform a locking action against downward displacement of the dentellated tab.

The lever 20 is furthermore provided with an operating end, indicated by the reference numeral 25, which can be operated to uncouple the engagement teeth from the dentellated tab.

As is schematically indicated with a broken line in FIG. 2, it is possible to vary the support provided by the shaped body 1 for the leg simply by varying the position of the shaped body 1 with respect to the quarter, and in particular by rotating forwards the shaped body 1 a greater support is achieved, while the degree of support decreases by rotating the shaped body backwards, i.e. anticlockwise with reference to the illustration.

The presence of the dentellated lever structured as described above causes the position assumed by the shaped body to remain stable since all the acting actions would tend to push the dentellated tab back downwards, said tab being prevented from moving in this direction by the teeth of the lever 20.

In order to change the position or to move backwards the shaped body 1, it is sufficient to act on the operating end of the small lever 20, consequently performing the uncoupling of the engagement teeth 23 from the teeth 11 of the dentellated tab 10.

Figure 3:
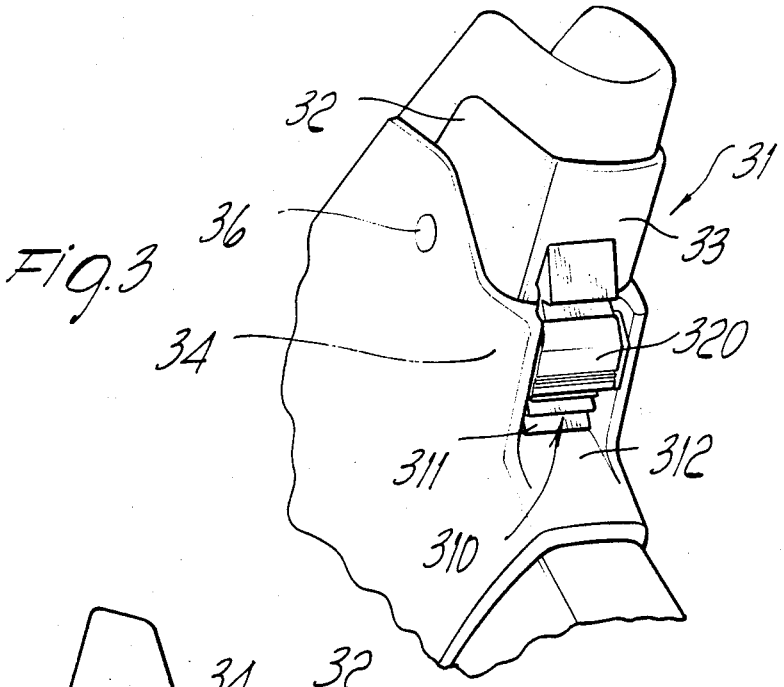
FIG. 3 is a schematic perspective front view of a quarter of a ski boot bearing a front support adjuster, according to the invention.
Figure 4:
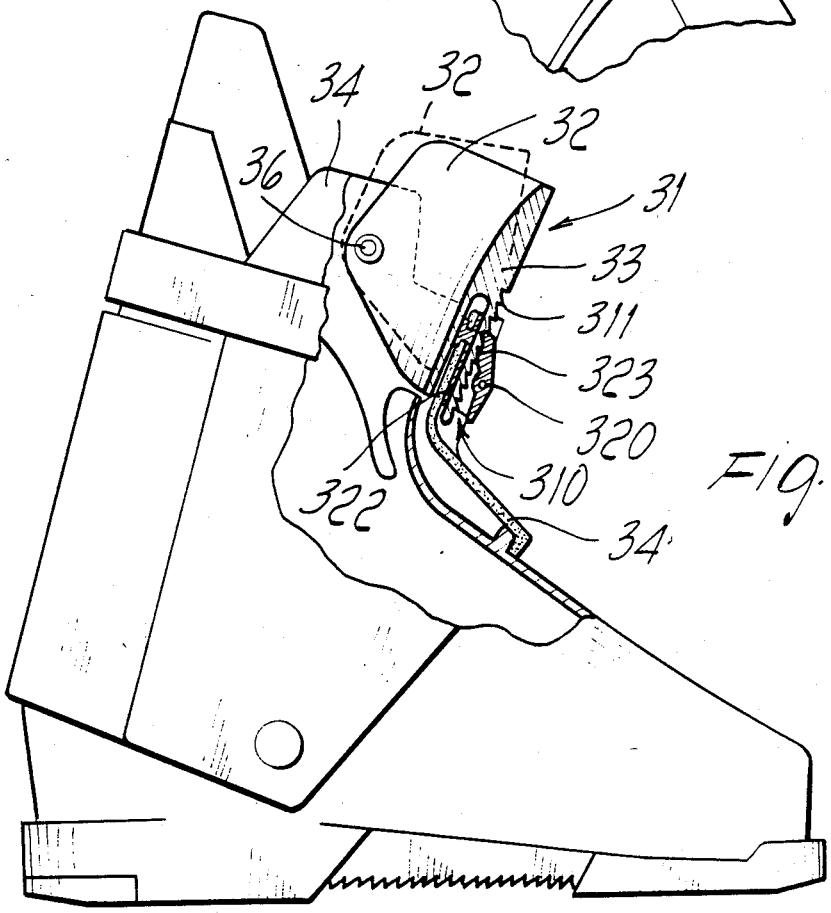
FIG. 4 is a longitudinal cross section view of the support adjuster of FIG. 3.

FIGS. 3 and 4 illustrate another embodiment of the support adjuster, in which a shaped body, generally indicated by the reference numeral 31, is shaped so as to embrace at least a portion of the front part of the leg of a skier. The shaped body 31 comprises lateral fins 32, tapering backwards, which join at a central portion 33 which can be positioned substantially at the tibia of a skier.

The fins 32 are connected to the quarter 34, at their rear end, e.g. by means of a hinge, similarly to what has been described above, by means of pivots 36, thus allowing an oscillation of the shaped body 31 about an axis which is transverse to the longitudinal extension of the leg and of the foot.

From the connecting portion 33, a dentellated tab 310 extends downwards, with saw-like teeth 311, which is accommodated in a recess 312 defined on the outer part of the quarter; the shaped body 31 is instead accommodated mainly inside the quarter. Releasable locking means are furthermore provided, fully similar to what has been described above, comprising a small lever 320 pivoted to its supporting base 322 and provided, at one end, with engagement teeth 323 which couple with the saw-like teeth 311 of the dentellated tab 310. As is schematically indicated with a broken line in FIG. 4, it is possible to vary the tibial support provided by the shaped body 31 to the leg by varying the position of the shaped body 31 with respect to the quarter: in particular, by rotating the shaped body backwards a greater support is achieved, while by rotating the shaped body forwards tibial support is decreased.

Figure 5:
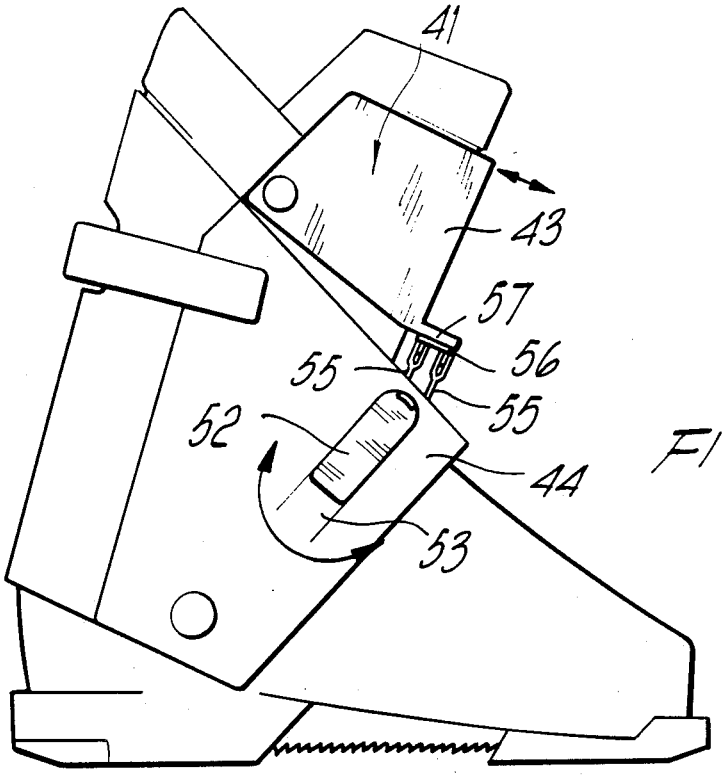
FIG. 5 is a lateral elevation view of a quarter of a ski boot with a front support adjuster and locking means composed of a system of connecting rods.
Figure 6:
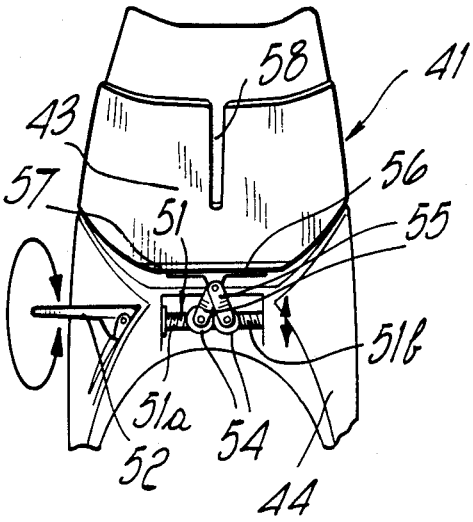
FIG. 6 is a partly cut-away front view of the system of connecting rods of FIG. 5 in the position of maximum backward inclination of the shaped body.
Figure 7:
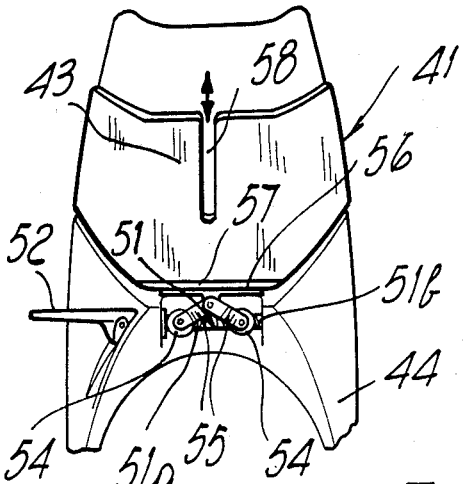
FIG. 7 is the same view as FIG. 6 with the locking system in the position of maximum forward inclination.

FIGS. 5–7 illustrate another embodiment of the releasable locking means, applied in this case to a front support adjuster and similar to the devices described in the European patent application N. 86100791.2 filed on Jan. 22, 1986 and U.S. Pat. No. 4.523.395.

The locking device comprises a bar 51, with portions with opposed threads, rotatably supported at the front part of the quarter 44. To one end of the bar 51, on the outside of the quarter, a grip and operation lever 52 is pivoted which, when not in use, can be flush-fitted in a recess 53 provided on the outer lateral surface of the front quarter 44.

With the portions of the opposed thread, indicated with **51*a* and 51*b*, of the bar 51, couple two sliders 54 which are prevented from rotating so that a rotation of the bar 51 corresponds to an opposite motion of the same sliders. The end of a pair of connecting rods 55 is articulated to the sliders, which rods, at their other end, are mutually connected to an abutment 56 rigidly associated with a tab 57 extending from the central portion 43 of the shaped body 41**.

With the arrangement described, by acting on the operating lever 52 and causing the rotation in one direction of the bar 51, there is a corresponding motion of the sliders 54, which move reciprocally closer towards the middle portion of the bar 51, so that the two connecting rods 55 move the abutment 56 away from the bar 51, which abutment, by acting on the tab 57, causes a greater backward inclination of the shaped body 41 (FIG. 5). Similarly, by rotating the bar 51 in the opposite direction, the sliders 54 move towards the ends of the bar 51 and consequently the abutment 56 moves closer to the bar 51, inclining the shaped body 41 forwards.

The alteration of the inclination of the shaped body 41, i.e. the adjustment of the support, is obtained by simply extracting the operating lever 52 from its recess 53, rotating, by means of the same lever 52, the bar 51 until one obtains the required position of the shaped body 41 and finally by returning the lever 52 to the recess 53 so as to prevent unwanted rotations of the bar 51.

Advantageously, the shaped body 41 is provided, in its central portion 43, with a slot 58, which extends preferably vertically in the upper region of the central portion 43: the slot 58 allows a slight elastic deformation of the shaped body 41, thus rendering the support on the leg of the skier less rigid.

Figure 8:
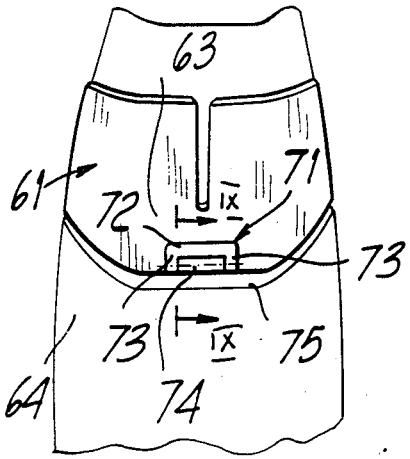
FIG. 8 shows, in a partial front view, a first mechanism based on an eccentric for an adjustment and removable locking operation.
Figure 9:
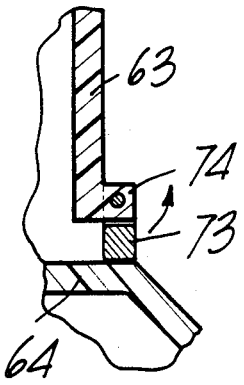
FIG. 9 is a diagrammatic section according to line IX—IX of FIG. 8.

In FIGS. 8–9 another embodiment of the means for adjusting and releasably locking is shown comprising a small block 71 eccentrically pivoted on the central portion 63 of the shaped body 61, about a horizontal axis which extends transversally to the longitudinal axis of the ski boot. The small block 71 comprises a main portion 72 and two flaps 73 which encircle an appendix 74 provided externally on the central portion 63.

The small block 71 is connected to the central portion 63 by means of the two flaps 73 which are hinged onto the appendix 74, for instance by means of a not shown screw. The eccentric based adjustment mechanism is capable of taking two positions: a first position of minimal abutment (FIG. 8), in which the small block 71 is turned up-wards, thereby leaving free a gap 75 between the shaped body 61 and the quarter 64 (in this way a rotation towards the outside of the shaped body is possible); a second position of maximum abutment (FIG. 9) in which the small block 71 is downwardly rotated so as to prevent a rotation towards the outside (in the clockwise direction when viewing FIG. 9) of the shaped body 61 with respect to the quarter. Undesired rotation of the small block 71 are prevented by the friction existing between the contacting and facing surfaces of the flaps 73 and appendix 74.

Figure 10:
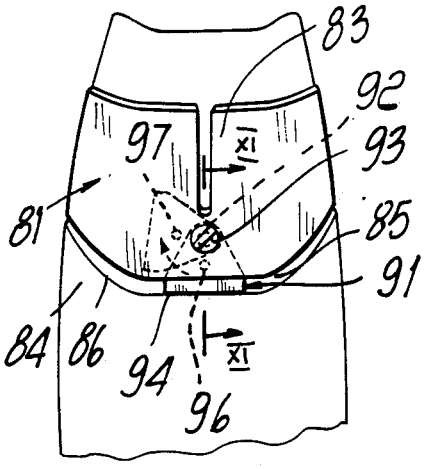
FIG. 10 shows in a partial front view, a second eccentric based mechanism for adjustment and removable locking operation.
Figure 11:
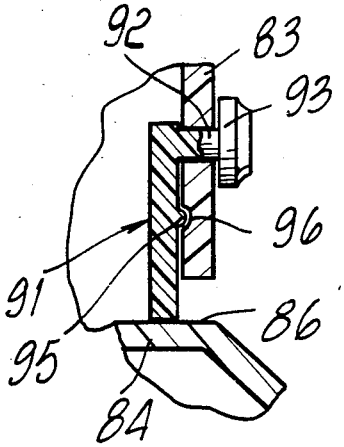
FIG. 11 is a diagrammatic section according to line XI—XI of FIG. 10.

In FIGS. 10 and 11 another embodiment of the mechanism for a releasable locking is shown, comprising an eccentric 91 pivoted onto the shaped body 81, in a central portion 83 thereof, about an horizontal axis which is parallel to the longitudinal axis of the ski boot. The eccentric 91 is preferably positioned at the inside of the shaped body 81 and is provided with a pin 92 which is received in a hole provided in the central portion 83 and on which a handle 93 is fixed, which is located at the outside of the shaped body 81. In this way a turnable connection between the shaped body 81 and the eccentric 91 is obtained as well as an external actuation means for the rotation of the eccentric 91. The eccentric 91 shows an enlarged base 94 with a profile corresponding to that of an edge 86 of quarter 84, thereby preventing an external inclination (maximum abutment) of the shaped body 81, when the eccentric 91 is in a vertical position in which it abuts against the edge 86 of the quarter.

When the eccentric 91 is in a horizontal position (shown in dotted lines in FIG. 10) it does not interfere anymore with the edge 86 of the quarter 84, thereby allowing an inclination towards the outside (minimum abutment) of the shaped body 81. The adjustment of the abutment takes place in the following way: when the eccentric 91 is in a vertical position the maximum abutment takes place; in order to pass into the minimum abutment position it is necessary to incline the shaped body towards the inside (anticlockwise direction when viewing FIG. 11) for istance without the foot beeing put into the ski boot, and rotating the handle 93 until the eccentric 91 is brought into the horizontal position. The profile itself of the eccentric owing to the enlarged base 94 prevents an undesired rotation of the same, but in order to further fix the position of the eccentric it is possible to provide on the surface of the eccentric 91 turned towards the inside of the shaped body 81, a tooth 95 which may be engaged in the seats 96 and 97 provided on the internal surface of the shaped body 81.

The support adjuster according to the invention, in all the embodiments described, can be used on any kind of ski boot, both of the conventional monolithic type and of the rear-entry type with the rear quarter pivoted to the shell, and, again, of the type having the front quarter separate from the rear quarter.

From what has been described, it can thus be seen that the invention achieves the intended aims, and in particular the fact is stressed that, with extremely simple means, a ski boot is provided which offers the user the possibility of altering as desired the support offered rearwardly and possibily frontally to the leg by the quarter, so as to better adapt to the habits and the needs of the user.

In practice, the materials employed, as well as the dimensions and the contingent shapes, may be any according to the requirements.

I claim:

1. In a ski boot of the type comprising a foot portion supporting front quarter and a rear quarter and a boot closure means for exerting a clamping action on a skier's foot, a support adjuster device associated with at least one of said front and rear quaters and arranged for bearing against a tibial portion, respectively a calf portion of a skier's lower leg, said support adjuster device including a main body shaped to at least partially embrace said tibial portion, respectively said calf portion of the skier's lower leg and means for movably connecting said body with the upper end of the associated quarter, the improvement consisting in that said support adjuster device further comprises portion adjustment means for selectively adjusting the position thereof with respect to the associated quarter independently from the operating position of said boot closure means, releasably locking means being provided for releasably locking said device in said independently adjusted position, to thereby cause said device to exert on said tibial portion, respectively said calf portion of the skier's lower leg a supporting action of selected value independent from the clamping action exerted on the skier's foot by said boot closure means, wherein said main body comprises a pair of lateral fins extending on either side of said tibial portion, respectively said calf portion of the skier's lower leg, the fins of said pair being mutually connected by a central portion extending transversely of said lateral fins and arranged to face said tibial portion, respectively said calf portion of the skier's lower leg, and wherein said movably connecting means comprises a pivot means provided on each lateral fin of said pair in a location proximate a free end thereof for oscillably coupling said main body with a respective one of said front and rear quarters to thereby permit forward and backward oscillation thereof in a substantially vertical plane parallel to the wearer's foot and wherein said position adjustment means comprises an elongated tab extending downwardly from said central portion of said main body along a substantially parallel direction to the skier's lower leg, each quarter having proximately to the upper end thereof a recess providing a longitudinal passage for said tab, the position of said tab with respect to said recess defining the positional adjustment of said device with respect to the associated quarter.

2. A support adjuster device, according to claim 1, wherein said releasable locking means comprises a ratcheted formation having saw-like teeth provided on an outer surface of said tab, and a small lever pivotally mounted with a middle portion thereof on a respective quarter, said lever having at one end thereof a plurality of engaging teeth cooperating with the teeth of said ratcheted formation so as to releasably lock said tab against downward movement thereof while permitting upward sliding movement thereof, there being further provided elastic means acting on said lever to cause said toothed end thereof to normally engage with said ratcheted formation, the other end of said lever being manually operable against the bias of said elastic means to unlock said toothed end of said lever from said ratcheted formation.

* * * * *